United States Patent [19]

Schroeder

[11] 3,951,067

[45] Apr. 20, 1976

[54] WIDE DISPERSION INCENDIARY DEVICE

[75] Inventor: Fred Schroeder, Lakeview Terrace, Calif.

[73] Assignee: Dow Corning Corporation, Midland, Mich.

[22] Filed: July 11, 1974

[21] Appl. No.: 487,476

[52] U.S. Cl. ..... 102/65; 102/66; 102/68; 102/90; 102/6

[51] Int. Cl.[2] ..... F42B 13/46

[58] Field of Search ..... 102/6, 65, 66, 68, 90; 149/19.1, 19.2, 19.3

[56] References Cited

UNITED STATES PATENTS

| | | | |
|---|---|---|---|
| 2,949,352 | 8/1960 | Cramer | 149/19.2 |
| 3,411,964 | 11/1968 | Douda | 149/19.2 |
| 3,489,088 | 1/1970 | Ballmoos et al. | 102/68 |
| 3,669,020 | 6/1972 | Waite et al. | 149/19.3 |

FOREIGN PATENTS OR APPLICATIONS

| | | | |
|---|---|---|---|
| 560,822 | 4/1957 | Italy | 102/66 |

*Primary Examiner*—Verlin R. Pendegrass
*Attorney, Agent, or Firm*—Howard W. Hermann

[57] ABSTRACT

A wide dispersion incendiary device such as artillery round, bomb, or grenade in which a high explosive charge within a casing has imbedded therein a plurality of hollow metallic objects such as balls. The hollows communicating with the exterior of the objects and being filled with incendiary material which is ignited by detonation of the high explosive. The incendiary material is a mixture of silicone rubber, powdered magnesium, and an oxidizing agent.

8 Claims, 7 Drawing Figures

WIDE DISPERSION INCENDIARY DEVICE

BACKGROUND OF THE INVENTION

The present invention relates to incendiary devices which are designed to ignite combustible material and are dispersed by means of an explosive charge. Such devices have both military use in the destruction of property and war material and civilian application, for example, in starting backfires for forest fire control. Several types of incendiary devices of the general type contemplated by the present invention have been used in the past. One common type has used a pelleted flowing, powdery mixture of metal and oxidizer which is dispersed upon explosion of an explosive charge. Such devices, of course, inherently have an obvious hazard insofar as handling is concerned because the materials are spontaneously reactable. Further, they are not totally satisfactory because the pellets tend to disintegrate and burn too rapidly or to detonate themselves. The explosive charge tends to disperse the powders in an erratic manner, and over a very short range before burn-out occurs. Thus, neither uniformity nor extent of distribution is often optimum.

Another type of known device makes use of fragments of solid compositions such as zirconium-misch metal or Thermits. These materials can be cast into a proper form such as the lining of a shell casing which is then filled with an explosive charge. They tend to suffer, however, from handling difficulties due to vacuums and pressures needed for fabrication and to early burn-out and failure to ignite ambient combustible material. Further these materials are brittle and tend to disintegrate into extremely fine particles upon exposure to the pressures of detonation, resulting in a quick burning powder. Misch metal and zirconium also require outside oxygen and thus are ineffective under water or other liquids or at high altitudes where oxygen is scarce.

SUMMARY OF THE PRESENT INVENTION

It is, therefore, an object of the present invention to provide a new incendiary device which eliminates the shortcoming mentioned above in connection with the prior art. There is provided according to the present invention a wide dispersion incendiary device comprising a casing enclosing a quantity of high explosive charge which has imbedded therein a plurality of hollow metallic objects such as balls, the hollows in the objects communicating with the exterior of the objects and being substantially filled with an incendiary material whereby the incendiary material is ignited and dispersed by detonation of the high explosive charge. The use of metallic objects increases substantially the range over which the incendiary material is dispersed upon detonation and acts as a perforator for the incendiary to be carried into intimate contact with contained materials such as fuel. The extended range is realized, by first, the weight of the metallic object which contains the incendiary material as compared to its volume and secondly, because ignition of the incendiary material initially takes place at the point of communication between the high explosive and the incendiary material which is exposed thereto; the metal serving to protect the remainder of the incendiary material from immediate ignition requiring a finite time for the incendiary material at the center of the object to ignite. Further, the aperture interconnecting the hollow in the object with the exterior thereof tends to concentrate the flame being emitted from the incendiary material thereby further insuring ignition of ambient combustibles at the point where the object comes to rest after finishing its trajectory from the point of explosion of the high explosive.

The incendiary material according to the present invention is made up of a mixture of magnesium powder and oxidizer in a silicone rubber binder as described in my copending application Ser. No. 487,474, filed concurrently herewith and entitled "Incendiary Composition." The silicone rubber serves to isolate the magnesium powder from the oxidizer thus providing safety in handling and also provides a supply of oxygen to the magnesium so that the system is not dependent upon ambient air for an oxygen source for burning.

BRIEF DESCRIPTION OF THE DRAWINGS

Other objects and attendant advantages of the present invention will become known to those skilled in the art from a reading of the following detailed description in connection with the accompanying drawings wherein.

DESCRIPTION OF THE PREFERRED EMBODIMENTS

Figure 1:
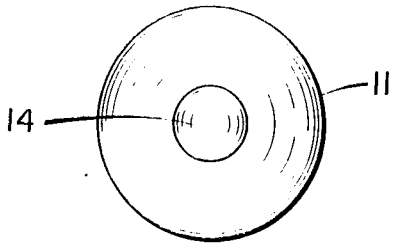
FIG. 1 is a view in perspective of a metallic ball filled with incendiary material according to the present invention.

Referring now to the drawings wherein like reference characters designate like or corresponding parts throughout the figures thereof there is shown in FIG. 1 a metallic ball 11 which is hollow and has a pair of apertures 12 and 13 extending therethrough and communicating between the hollow and the exterior of the ball 11. The hollow is filled, as may be seen more clearly from FIG. 2, with an incendiary material 14 ignitable by detonation of a high explosive charge surrounding the ball as will be described more clearly hereinafter.

In a preferred embodiment steel was used as the material for the ball 11 and the incendiary material was made up of a cured mixture of 25% by weight room temperature vulcanizing silicone rubber, 25% magnesium powder of 320 mesh particle size, and 50% by weight $Fe_3O_4$. A suitable silicone rubber RTV is commercially available under the designation of Dow Corning 3110 RTV encapsulant. The magnesium powder is preferably ground rather than spherical thus providing greater surface area. Alternatively, other metals can be used for the ball 11 and other incendiary materials can be used to fill the hollows therein as described in my aforementioned copending application. The device was made by filling a steel tube with the incendiary material, cutting it into segments of short lengths and placing the segments in a forming die to partially close the ends thereof resulting in substantially spherical bodies having the incendiary material extending outwardly from the holes in the ends of the steel sphere.

Figure 2:
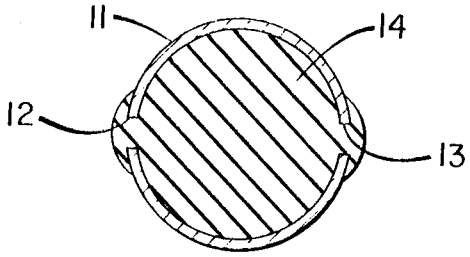
FIG. 2 is a cross-section of the ball shown in FIG. 1.

As may be seen more clearly from FIG. 2 it is preferred that the incendiary material 14 extend outwardly beyond the periphery of the metallic ball to thereby increase the surface area exposed to the high explosive charge which will surround the ball when the ball is imbedded therein. This effectively increases the surface area exposed to the high explosive and thus tends to insure ignition of the incendiary material upon detonation of the explosive charge.

Figure 3:
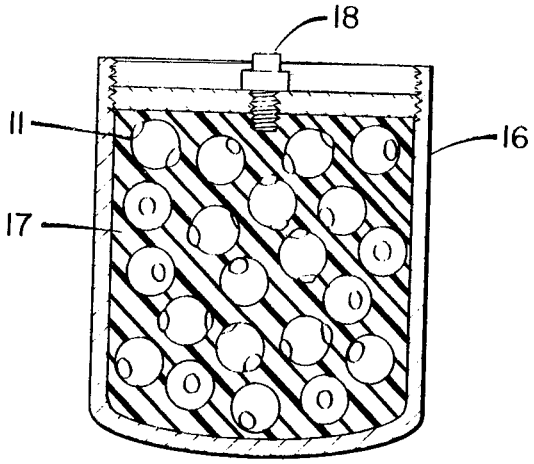
FIG. 3 is a cross-sectional view of a grenade made in accordance with the present invention incorporating a plurality of the balls shown in FIGS. 1 and 2.

FIG. 3 illustrates somewhat diagrammatically a hand grenade in which the filled balls 11 are utilized. As shown the hand grenade is provided with a casing 16 containing a body of high explosive material 17 in which a plurality of the balls 11 containing the incendiary material 14 are imbedded. A suitable detonator 18 is provided in the casing for detonating the explosive charge. It is to be understood that the shape of the grenade forms no part of the present invention and that the invention is also applicable to any other type of explosive device such as, for example, an artillery round, or an air-dropped bomb. The method of delivery of the device to the point of detonation also forms no part of this invention, nor does the composition of the high explosive which may be, for example, one of those based on trinitrotoluene although any other suitable high explosive material can also be used.

Upon detonation of the high explosive the explosion causes dispersion of the balls and also ignition of the exterior surfaces of the incendiary material. The use of a metal adds density to the balls thus allowing them to be widely dispersed and to penetrate objects which may be in their paths in the course of their trajectory. The metal case serves to control the rate of burning of the incendiary material and thus insure that flame will still be emanating from the ball at the end of its trajectory. The apertures 12 and 13 serve to concentrate the flame emanating from the ball and further insure ignition of any combustibles when the ball alights on or near them.

Figure 4:
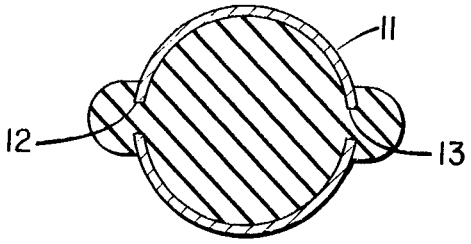
FIG. 4 is a cross-sectional view of a modification of the ball shown in FIG. 1.
Figure 5:
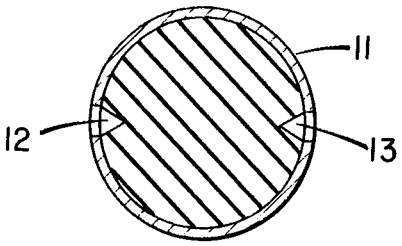
FIG. 5 is a cross-sectional view of a further modification of the ball shown in FIG. 1.
Figure 7:
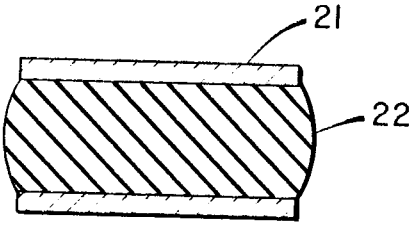
FIG. 7 is a cross-sectional view of the cylindrical device shown in FIG. 6.

As pointed out previously, it is desirable to provide substantial surface area of the incendiary material where it is exposed to the high explosive in order to insure ignition. In FIG. 4 there is shown an embodiment wherein the incendiary material extends substantially beyond the apertures 12 and 13 in the metallic ball. A reversed type of configuration is shown in the embodiment illustrated in FIG. 5. Instead of extending the incendiary material from the apertures 12 and 13 the material is depressed to obtain the necessary surface area. In the embodiment shown in FIG. 5 a portion of the high explosive actually enters the depressions inside the metallic ball 11.

Figure 6:
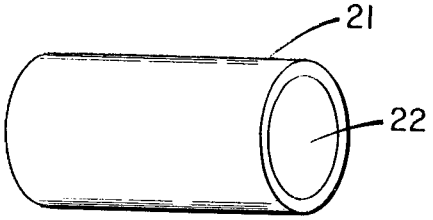
FIG. 6 is a view in perspective of a cylindrical object which can be used instead of the ball shown in FIG. 1.

FIG. 6 illustrates a metallic cylinder 21 filled with an incendiary material 22 for the same purposes as was hereinabove described with respect to the metallic ball 11 and incendiary material 14. It is utilized in a similar fashion and this embodiment is shown merely to describe the fact tht the metallic objects need not be ball shaped in order to function in accordance with the present invention.

Obviously, many other variations and modifications of the present invention will also become obvious to those skilled in the art from a reading of the foregoing. It is to be understood therefore that within the scope of the appended claims the invention can be practiced otherwise than as specifically described.

That which is claimed is:

1. An incendiary device comprising
a casing defining an enclosed void,
a high explosive charge filling said void,
detonating means in said casing for detonation of said high explosive charge, and
a plurality of hollow metallic objects imbedded in said high explosive charge, the hollow in said objects communicating with at least one aperture in the exterior of said objects and being substantially filled with incendiary material whereby said incendiary material is ignited and dispersed by detonation of said high explosive charge and wherein said incendiary material extends outwardly beyond the periphery of said metallic objects to thereby increase the surface area exposed to said high explosive.

2. An incendiary device as defined in claim 1 wherein said hollow objects are metallic balls.

3. An incendiary device as defined in claim 1 wherein said incendiary material comprises magnesium powder and an oxidizer in a silicone rubber binder.

4. An incendiary device as defined in claim 1 wherein said metallic objects are cylindrical.

5. An incendiary device comprising
a casing defining an enclosed void,
a high explosive charge filling said void,
detonating means in said casing for detonation of said high explosive charge, and
a plurality of hollow metallic objects imbedded in said high explosive charge, the hollows in said objects communicating with at least one aperture in the exterior of said objects and being substantially filled with incendiary material whereby said incendiary material is ignited and dispersed by detonation of said high explosive charge and wherein the surface area of incendiary material exposed to said high explosive is greater than the area of the apertures in said metallic objects, a portion of the incendiary material being recessed in the apertures to a point below other portions in each object to provide the greater exposed surface area.

6. An incendiary device as defined in claim 5 wherein said hollow objects are metallic balls.

7. An incendiary device as defined in claim 5 wherein said incendiary material comprises magnesium powder and an oxidizer in a silicone rubber binder.

8. An incendiary device as defined in claim 5 wherein said metallic objects are cylindrical.

* * * * *